US007315715B2

(12) United States Patent
Tsuda et al.

(10) Patent No.: US 7,315,715 B2
(45) Date of Patent: Jan. 1, 2008

(54) APPARATUS, METHOD, AND PROGRAM FOR IMAGE FORMING

(75) Inventors: Kiyonori Tsuda, Kanagawa (JP); Misaki Uchiyama, Tokyo (JP)

(73) Assignee: Ricoh Co. Ltd., Tokyo (JP)

( * ) Notice: Subject to any disclaimer, the term of this patent is extended or adjusted under 35 U.S.C. 154(b) by 163 days.

(21) Appl. No.: 11/220,845

(22) Filed: Sep. 8, 2005

(65) Prior Publication Data

US 2006/0051136 A1 Mar. 9, 2006

(30) Foreign Application Priority Data

Sep. 8, 2004 (JP) ..... 2004-260671
Nov. 19, 2004 (JP) ..... 2004-336337

(51) Int. Cl.
*G03G 15/08* (2006.01)

(52) U.S. Cl. ..... 399/258; 399/259; 399/262; 399/263

(58) Field of Classification Search ..... 399/27, 399/120, 258, 259, 260, 262, 359, 263
See application file for complete search history.

(56) References Cited

U.S. PATENT DOCUMENTS 5,915,155 A 6/1999 Shoji et al.
6,125,243 A 9/2000 Shoji et al.
6,587,661 B1 * 7/2003 Shimmura et al. ..... 399/257
6,795,673 B2 9/2004 Yoshizawa
2004/0184841 A1 9/2004 Tsuda et al.
2004/0223790 A1 11/2004 Hosokawa et al.
2004/0258432 A1 12/2004 Hatori et al.
2004/0265011 A1 12/2004 Tsuda et al.
2005/0158071 A1 7/2005 Hosokawa et al.
2006/0051136 A1 3/2006 Tsuda et al.

FOREIGN PATENT DOCUMENTS

JP 7-146605 6/1995
JP 10-239974 11/1998
JP 2002-268353 9/2002
JP 3676923 5/2005

OTHER PUBLICATIONS

U.S. Appl. No. 11/748,533, filed May 15, 2007, Yoshida et al.
U.S. Appl. No. 11/612,865, filed Dec. 19, 2006, Tsuda et al.
U.S. Appl. No. 11/521,559, filed Sep. 15, 2006, Shimizu.

* cited by examiner

*Primary Examiner*—Hoang Ngo
(74) *Attorney, Agent, or Firm*—Oblon, Spivak, McClelland, Maier & Neustadt, P.C.

(57) ABSTRACT

An exemplary embodiment of the present invention, includes an image forming apparatus comprising a toner storage device storing a toner, an image forming device including a developer, and a toner transfer device provided between the toner storage device and the image forming device. The toner transfer device has a transfer passage, in which a powder is placed before activation of the toner transfer device.

23 Claims, 13 Drawing Sheets

APPARATUS, METHOD, AND PROGRAM FOR IMAGE FORMING

BACKGROUND OF THE INVENTION

1. Field of the Invention

The following disclosure relates generally to an apparatus, method, and computer program and product for image forming.

2. Description of the Related Art

In a background image forming apparatus, a developing device and a toner container are provided separate from each other to reduce the apparatus size. For example, U.S. patent application Ser. No. 10/667301 (the '301 patent application), the entire contents of which are hereby incorporated by reference, describes an image forming apparatus including a process cartridge provided with a developing device, a toner container storing a toner, and a toner conveying device for conveying the toner from the toner container to the developing device. The toner conveying device is provided with an inclined pipe such that the toner from the toner container flows into the developing device through the toner conveying device under its own weight. However, this configuration may sometimes cause a problem.

For example, the toner in the toner container may have a high fluidity characteristic such that the toner tends to flow into the developing device in an amount larger than expected, thus causing scattering of toner or background contamination.

SUMMARY

An exemplary embodiment of the present invention includes an image forming apparatus comprising a toner storage device storing a toner, an image forming device including a developer, and a toner transfer device provided between the toner storage device and the image forming device. The toner transfer device has a transfer passage, in which a powder is placed before activation of the toner transfer device.

Another exemplary embodiment of the present invention includes a method for transferring a toner from a toner storage device to an image forming device through a transfer passage in an image forming apparatus. The method includes the steps of: placing a powder in the transfer passage before activation of the toner storage device; and transferring the powder together with the toner to the image forming apparatus after activation of the toner storage device.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
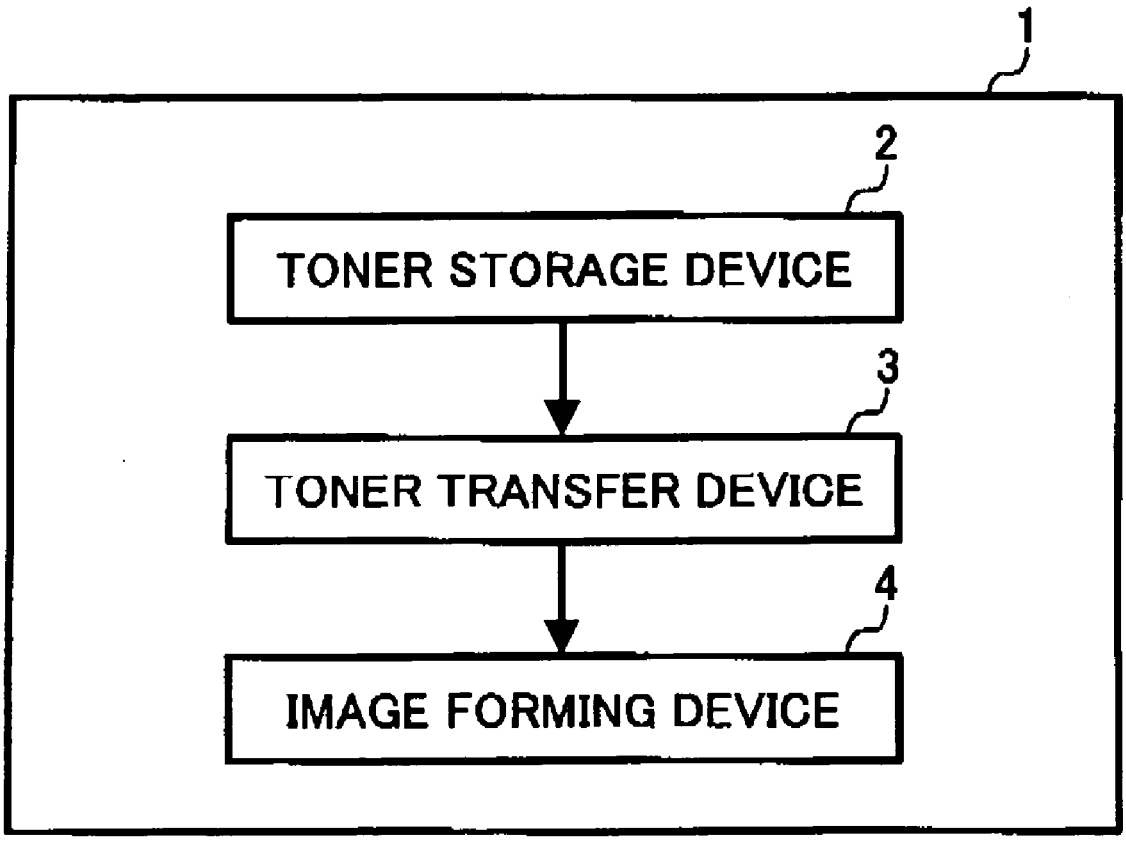
FIG. 1 is a schematic block diagram illustrating a structure of an image forming apparatus according to an exemplary embodiment of the present invention.

In describing the preferred embodiments illustrated in the drawings, specific terminology is employed for clarity. However, the disclosure of this patent specification is not intended to be limited to the specific terminology selected and it is to be understood that each specific element includes all equivalents that operate in a similar manner. Referring now to the drawings, wherein like reference numerals designate identical or corresponding parts throughout the several views, FIG. 1 illustrates an image forming apparatus 1 according to an exemplary embodiment of the present invention.

The image forming apparatus 1 includes a toner storage device 2, an image forming device 4, and a toner transfer device 3 provided between the toner storage device 2 and the image forming device 4. In this exemplary embodiment, the toner storage device 2 is removably installed on the image forming apparatus 1. The image forming device 4 is removably installed on the image forming apparatus 1 independently from the toner storage device 2. Further, the image forming device 4 is provided at a downside location of the toner storage device 2.

The toner storage device 2 stores a toner to be used for an image forming operation performed by the image forming apparatus 1. The image forming device 4 forms an image on a recording sheet using a developer, which is incorporated therein. In addition to the developer, the image forming device 4 may include various units to be used for an image forming operation, including a photoconductor, charger, discharger, cleaner, etc. The toner transfer device 3 has a transfer passage in its inside. During the image forming operation, the toner transfer device 3 transfers the toner from the toner storage device 2 to the developer through the transfer passage.

In this exemplary embodiment, a powder is placed in the transfer passage at a point in time before activation of the toner transfer device. As described above, when the toner has a high degree of fluidity, the toner may flow into the developer through the toner transfer device 3 with an amount larger than expected. To suppress the amount of toner flowing into the developer, the powder, such as a carrier or a developing agent, is placed in the transfer passage.

In one example, powder having an amount sufficient for preventing the toner from flowing into the developer may be placed in the transfer passage. In another example, powder in an amount sufficient for suppressing the fluctuation in toner density of the developer may be placed in the transfer passage. In another example, powder may be placed in a specific place in the transfer passage, which can prevent the toner from flowing into the developer.

Figure 3:
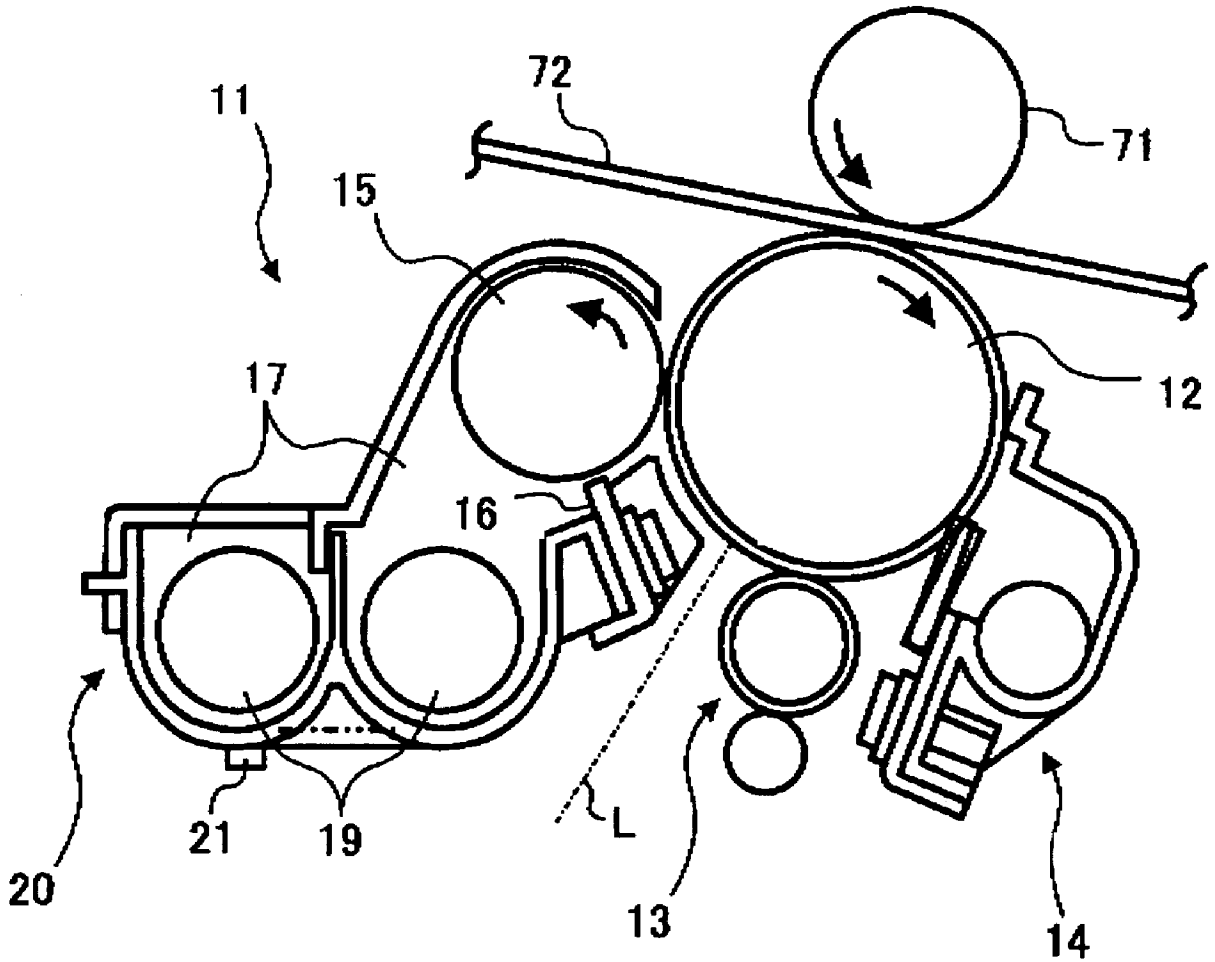
FIG. 3 is a schematic block diagram illustrating a structure of a process cartridge shown in FIG. 2.

The image forming apparatus 1 of FIG. 1 may be implemented by any kind of image forming apparatus capable of forming a toner image using an electrophotographic method, such as the image forming apparatus shown in FIG. 1 of the '301 patent application or the color printer shown in FIG. 3 of U.S. patent application Ser. No. 10/792694 (the '694 patent application), the entire contents of which are hereby incorporated by reference.

Figure 2:
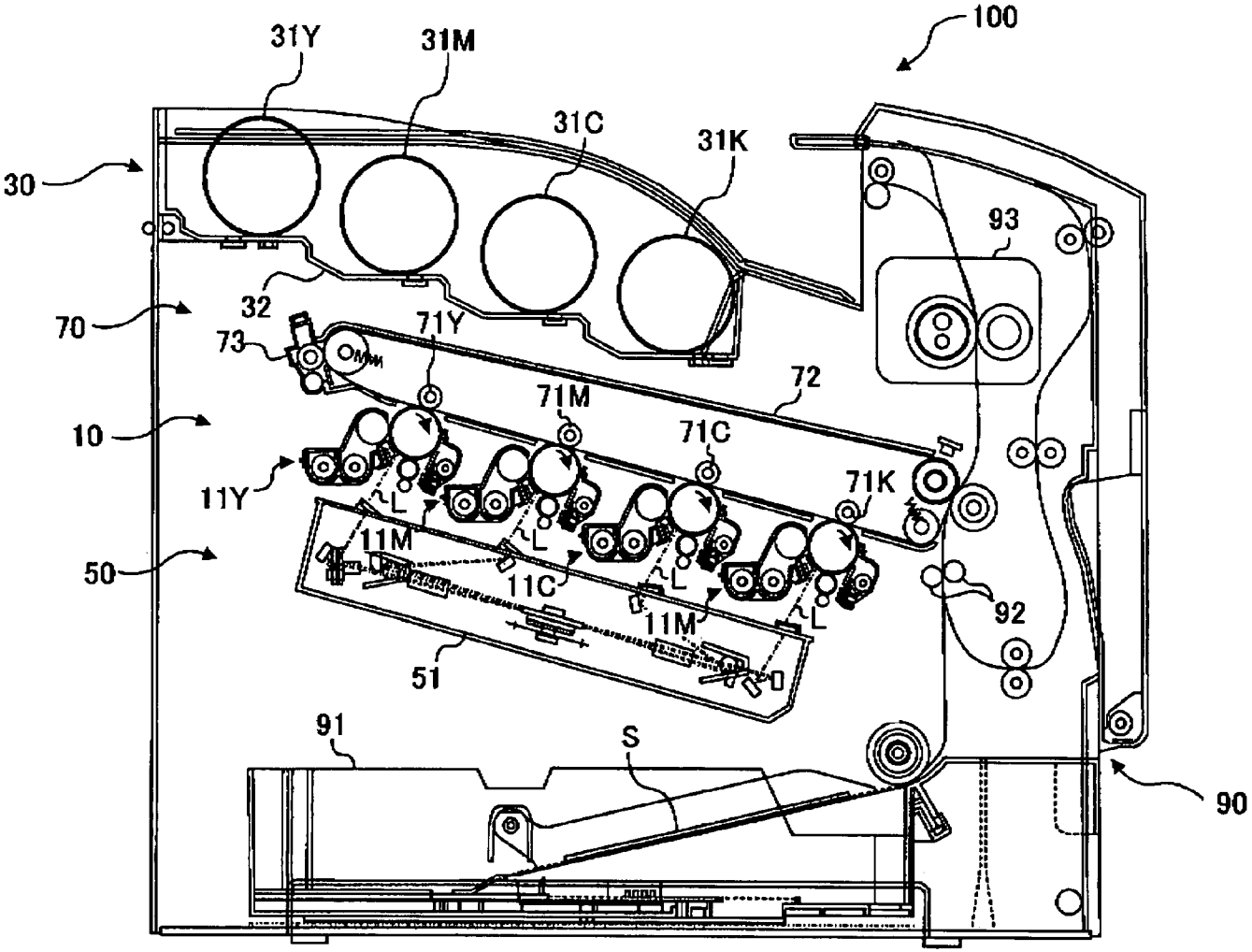
FIG. 2 is a schematic block diagram illustrating a structure of a copier according to an exemplary embodiment of the present invention.

Referring now to FIG. 2, a copier 100, which operates as the image forming apparatus 1 of FIG. 1, is explained according to an exemplary embodiment of the present invention. The copier 100 has a structure substantially similar to the structure of the image forming apparatus of FIG. 1 of the '301 patent application. As shown in FIG. 2, the copier 100 includes an image forming section 10, a toner storage section 30, an optical writing section 50, an intermediate transfer section 70, and a sheet transfer section 90.

The image forming section 10 includes an image forming device capable of forming a toner image on a recording sheet. In this exemplary embodiment, the image forming section 10 includes a process cartridge 11Y for forming a yellow toner image, a process cartridge 11M for forming a magenta toner image, a process cartridge 11C for forming a black toner image. The process cartridges 11Y to 11K (collectively referred to as the "process cartridge 11") are substantially similar in structure and function. For example, as illustrated in FIG. 3, the process cartridge 11 includes a photoconductor 12, a charger 13, a cleaner 14, a discharges (not shown), and a developer 20. The developer 20 includes a developer carrier 15, a developer regulator 16, a developer container 17, and a toner agitator 19. Further, any one of the process cartridges 11Y to 11K can be installed to or taken out from the copier 100 in a substantially similar manner as described referring to FIG. 9 of the '694 patent application, for example.

Figure 4:
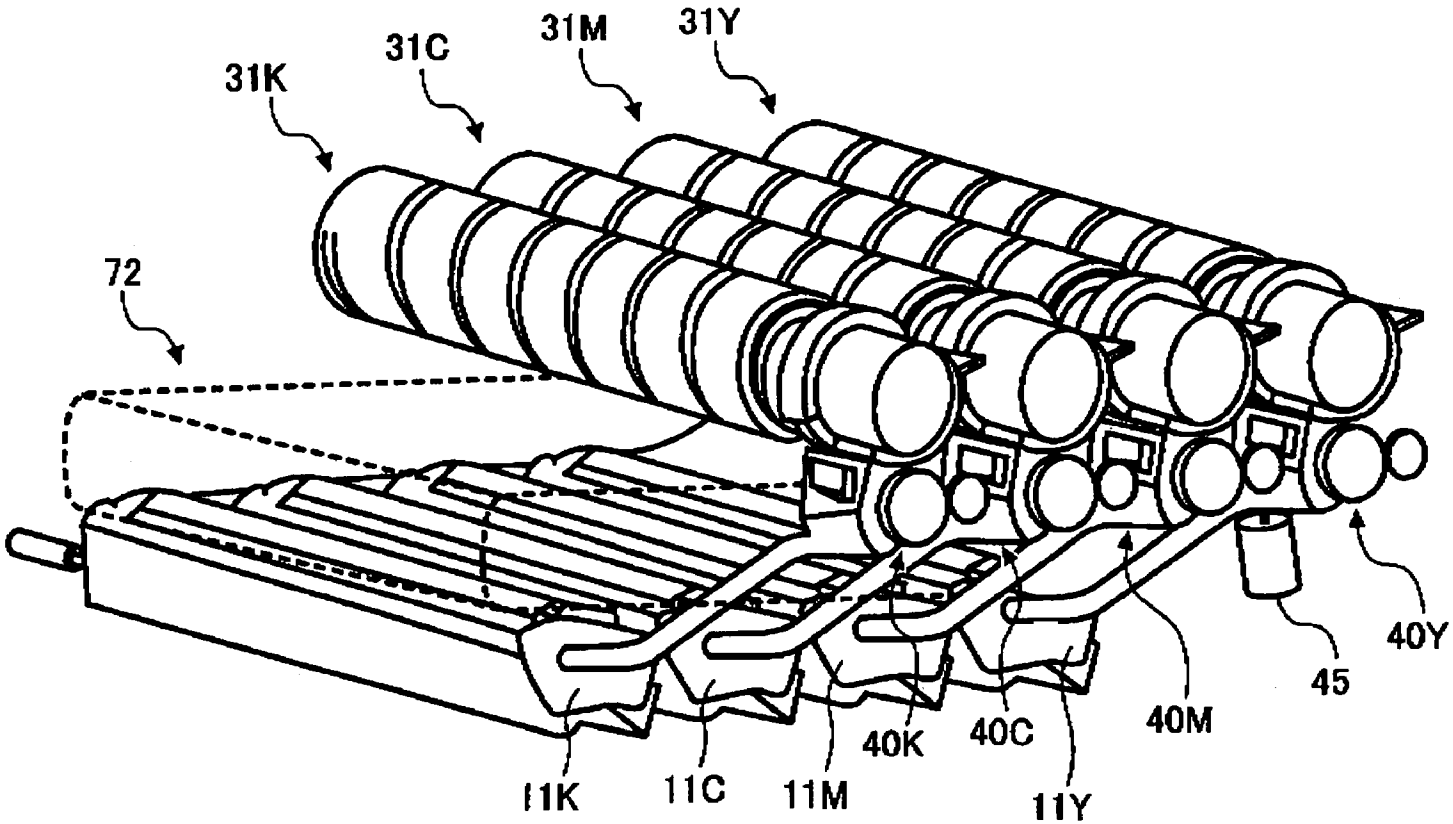
FIG. 4 is a perspective view illustrating a structure of a toner transfer device incorporated in the copier of FIG. 2.

Referring back to FIG. 2, the toner storage section 30 includes a toner storage device capable of storing a toner therein. In this exemplary embodiment, the toner storage section 30 includes a toner bottle 31 Y storing a yellow toner, toner bottle 31M storing a magenta toner, toner bottle 31C storing a cyan toner, and toner bottle 31K storing a black toner, each of which is supported by a bottle holder 32. Any one of the toner bottles 31Y to 31K (collectively referred to as the toner bottle 31) may have a structure substantially similar to the structure shown in FIG. 3 of the '301 patent application or the structure shown in FIG. 5 of the '694 patent application. For example, as illustrated in FIG. 6, the toner bottle 31 has a bottle body 33 storing the toner therein, a cap 34, a handle 35, and a toner guide 38. The cap 34, which is made of resin, is provided on one end of the bottle body 33. The handle 35 is integrally mounted on the cap 34. The toner guide 38 is formed as a spiral groove on the inner wall of the bottle body 33 to transfer the toner from the other end toward the bottle cap 34. In addition to these components, the toner bottle 31 includes a bottle gear (not shown), which is integrally, formed on the bottle body 33, and a shutter 37 (FIG. 7) slidably provided on the cap 34. The bottle gear is engaged with a motor gear (not shown) formed on a drive motor 45 of FIG. 6 such that it rotates as the motor gear is rotated by the drive motor 45. In this exemplary embodiment, the drive motor 45 is implemented by a brushless direct circuit (DC) motor. FIG. 6 illustrates only one toner bottle 31, however, four toner bottles 31Y to 31K are provided in the copier 100 as illustrated in FIG. 2 or FIG. 4.

Further, each of the toner bottles 31Y to 31K can be installed into or be removed from the bottle holder 32 for replacement, as described referring to FIG. 6 of the '694

The optical writing section 50 of FIG. 2-*mainly* includes an exposure unit 51 capable of irradiating a light L onto the surface of the photoconductor 12, i.e., the surfaces of the photoconductors 12Y, 12C, 12M, and 12K, respectively.

The intermediate transfer section 70 mainly includes a plurality of rollers including transfer rollers 71Y, 71M, 71G, and 71K, a transfer belt 72 wound around the plurality of rollers, and a belt cleaner 73 for cleaning the surface of the transfer belt 72.

The sheet transfer section 90 mainly includes a sheet container 91 having a stack of recording sheets S, a plurality of rollers including a registration roller pair 92, and a fixing unit 93 for fixing the toner onto the recording sheet S.

In addition to the devices illustrated in FIG. 2, four toner transfer devices 40Y, 40M, 40C, and 40K (collectively referred to as the toner transfer device 40) are provided between the toner storage section 30 and the image forming section 10 at a portion facing one side surface of the transfer belt 72 as illustrated in FIG. 4.

As shown in FIG. 4, the toner transfer device 40Y is provided between the toner bottle 31Y and the process cartridge 11Y to supply the yellow toner from the toner bottle 31Y to the developer container 17Y of the process cartridge 11 Y. The toner transfer device 40M is provided between the toner bottle 31M and the process cartridge 11M to supply the magenta toner from the toner bottle 31M to the developer container 17M of the process cartridge 11M. The toner transfer device 40C is provided between the toner bottle 31C and the process cartridge 11C to supply the cyan toner from the toner bottle 31C to the developer container 17C of the process cartridge 11C. The toner transfer device 40K is provided between the toner bottle 31K and the process cartridge 11K to supply the black toner from the toner bottle 31K to the developer container 17K of the process cartridge 11K.

Figure 5:
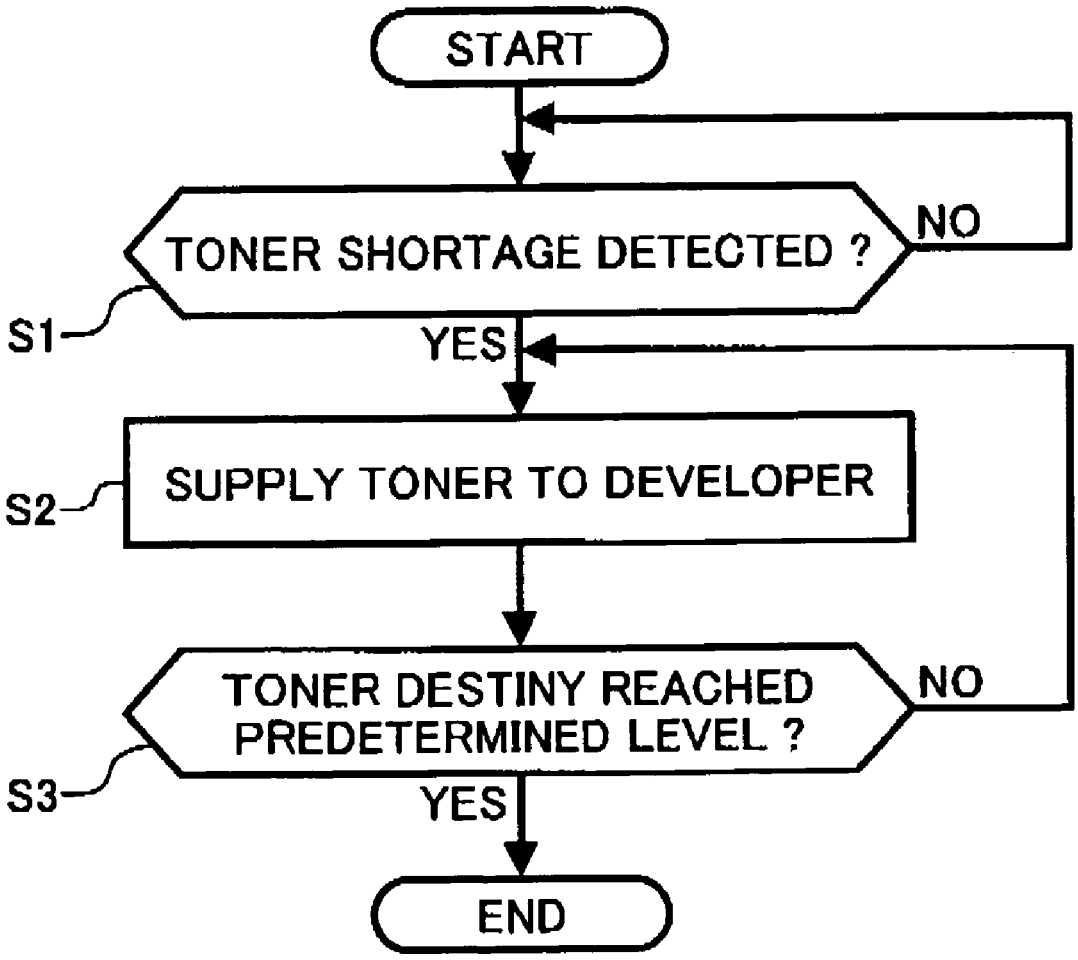
FIG. 5 is a flowchart illustrating an operation of supplying a toner, performed by the toner transfer device of FIG. 4, according to an exemplary embodiment of the present invention.
Figure 6:
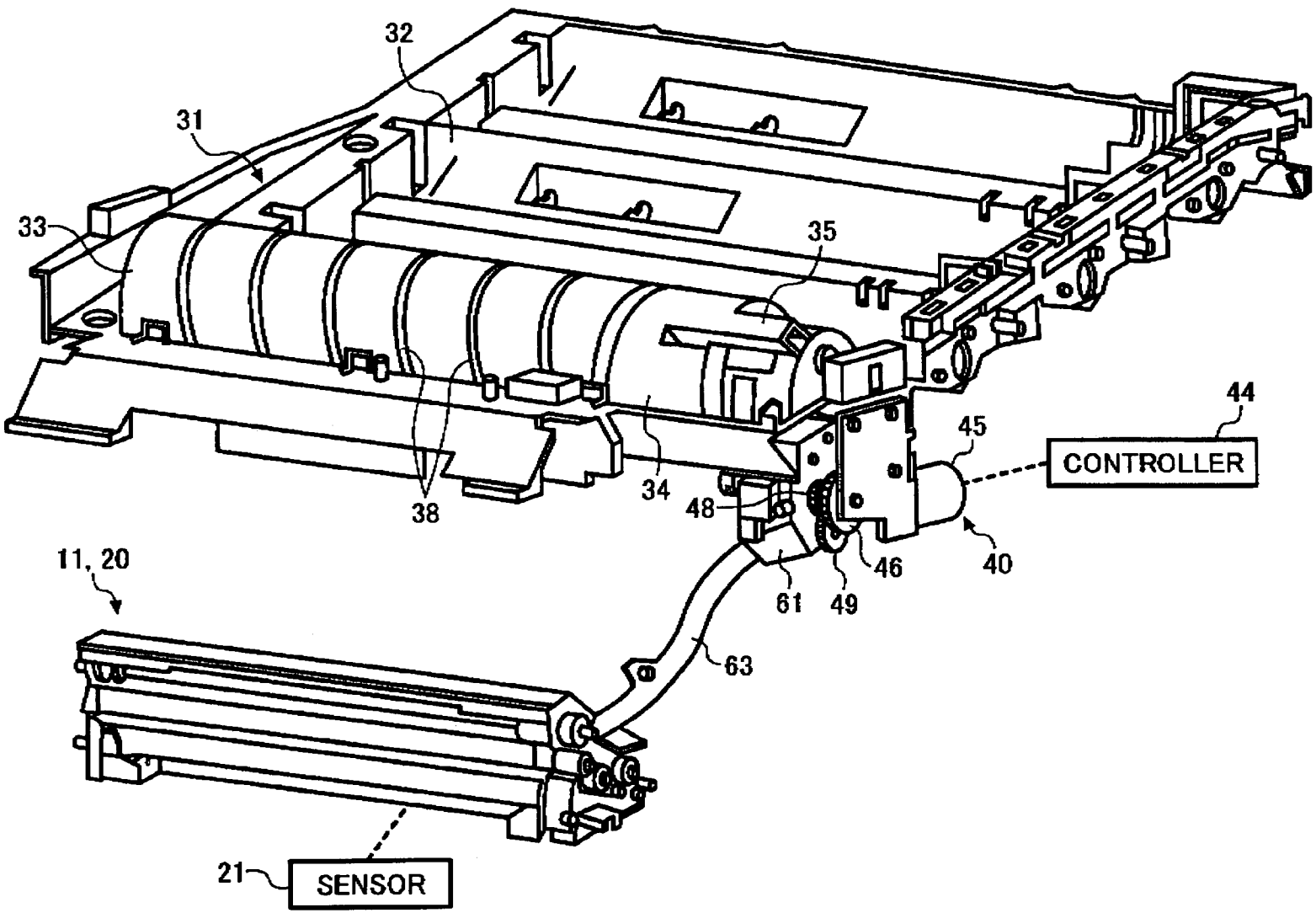
FIG. 6 is a perspective view illustrating a structure of a selected portion of the copier of FIG. 2 including the toner transfer device of FIG. 4.
Figure 7:
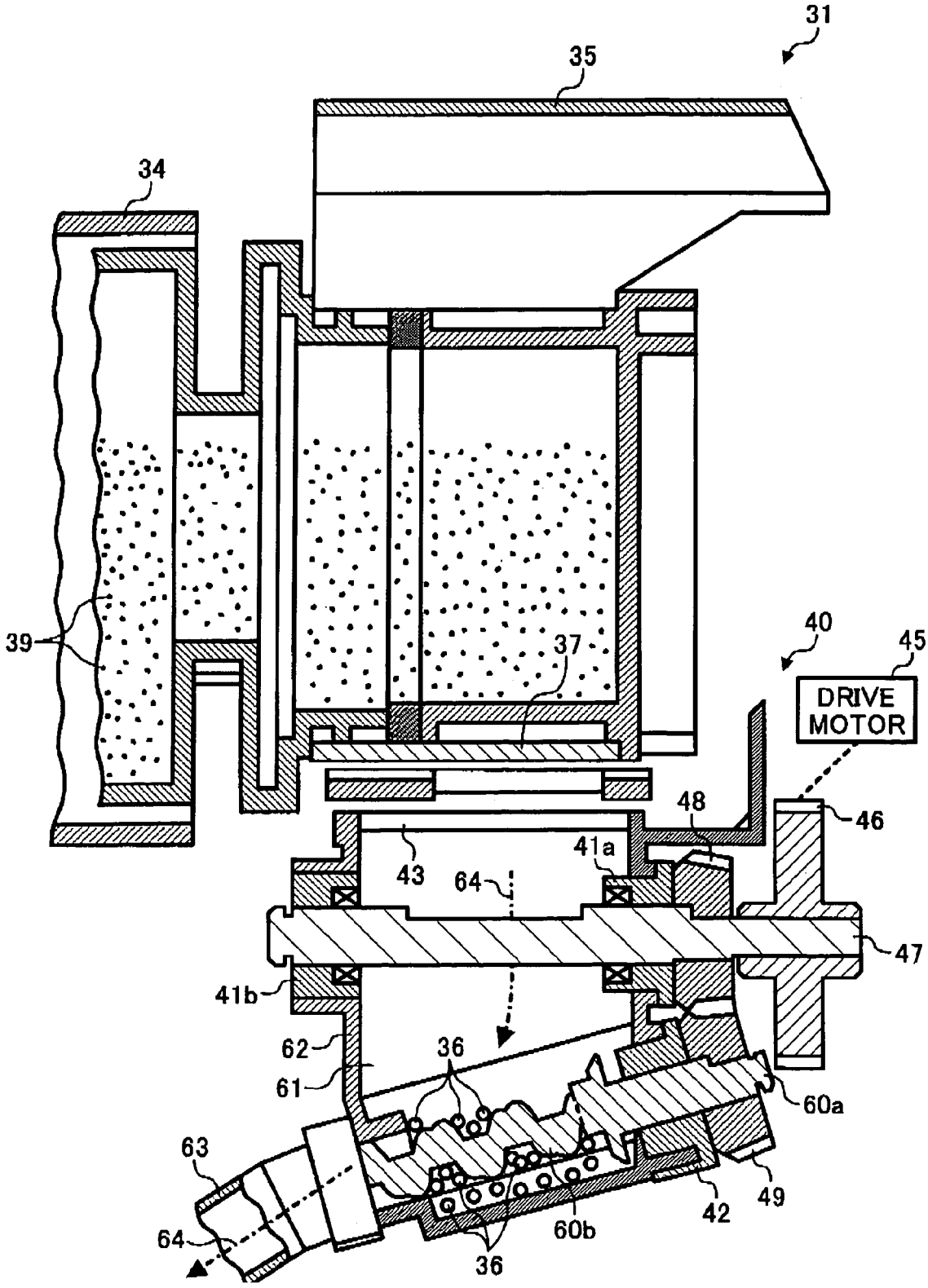
FIG. 7 is a cross-sectional view illustrating a structure of the toner transfer device of FIG. 4.

The transfer device 40 may have a structure substantially similar to the structure shown in FIG. 5 of the '301 patent application or the structure shown in FIG. 7 of the '694 patent application. For example, as illustrated in FIGS. 6 and 7, the transfer device 40 includes a first shaft receiver 41*a*, a second shaft receiver 41*b*, a third shaft receiver 42, an inlet 43, a first gear 46, a shaft 47, a second gear 48, a third gear 49, a rotating shaft 60*a*, a transfer coil 60*b*, a toner holder 61, and a transfer pipe 63. FIG. 6 illustrates only one toner transfer device 40, however, four toner transfer devices 40Y to 40K are provided in the copier 100 as illustrated in FIG. 4.

In this exemplary embodiment, the transfer pipe 63 is made of resin. The transfer coil 60*b*, which is made of resin, has one end inserted in the transfer pipe 63. The inside wall surface of the transfer pipe 63 and the outer surface formed by the transfer coil 60*b* are separated about 0.1 mm to 0.2 mm. The connection between the transfer coil 60*b* and the transfer pipe 63 is described in greater detail referring to FIG. 15 of the '301 patent application. The other end of the transfer coil 60*b* is wound around a portion of the rotating shaft 60*a* as shown in FIG. 7.

The shaft 47 is integrally formed on the first gear 46. Further, the shaft 47 is fixed onto an inner wall 62 of the toner holder 61 through the first and second shaft receivers 41*a* and 41*b*. The shaft 47 has a central portion covered by a flexible sheet. With this flexible sheet, the shaft 47 can agitate the toner accumulated in the toner holder 61 when the shaft 47 is rotated with the first gear 46. In this exemplary embodiment, the first gear 46 is engaged with the motor gear fixed onto the drive motor 45 such that it is driven by the drive motor 45. The second gear 48, which is integrally provided on the shaft 47, rotates as the drive 45 is driven.

The rotating shaft 60*a*, which is integrally formed on the third gear 49, is fixed onto the inner wall 62 of the toner holder 61 through the third shaft receiver 42. The third gear 49 is engaged with the second gear 48 such that the third gear 49 is rotated as the second gear 48 is rotated by the drive motor 45:

Referring back to FIG. 3, an image forming operation, performed by the process cartridge 11, is explained according to an exemplary embodiment of the present invention. The charger 13 uniformly charges the surface of the photoconductor 12, which is rotated clockwise. The exposure unit 51 (FIG. 2) irradiates the light L onto the surface of the photoconductor 12 to form an electrostatic latent image thereon.

The developer container 17 stores the toner, which is supplied from the toner bottle 31 (FIG. 4) through the toner transfer device 40 (FIG. 4). The toner in the developer container 17 is agitated and conveyed toward the developer carrier 15 by the toner agitator 19. The toner supplied to the developer container 17 is mixed with a carrier to form a developing agent. The developer carrier 15 may be implemented by a sleeve having a magnetic field generator in its inside. As the developer carrier 15 rotates in the counterclockwise direction, the layer of the developing agent is formed on the surface of the developer carrier 15. When the developing agent formed on the surface of the developer carrier 15 reaches the developer regulator 16, such as a doctor, an amount of the developing agent is regulated by the developer regulator 16 to a predetermined level. The predetermined amount of the developing agent is then carried to a nip formed between the developer carrier 15 and the photoconductor 12. At the nip, the electrostatic latent image formed on the surface of the photoconductor 12 is developed into a toner image.

The toner image carried by the photoconductor 12 is then transferred onto a recording sheet S carried by the transfer belt 72 at a nip farmed between the photoconductor 12 and the transfer roller 71.

Referring now to FIGS. 5 to 7, the operation of supplying a toner, performed by the toner transfer device 40, is explained according to an exemplary embodiment of the present invention. In this exemplary embodiment, the steps illustrated in FIG. 5 are performed by a controller 44 shown in FIG. 6, which controls an operation of the toner transfer device 40 through the drive motor 45.

The controller 44 may be implemented by a microcomputer having a central processing unit (CPU), a read only memory (ROM), and a random access memory (RAM), for example. The ROM stores a control program for controlling an operation of the drive motor 45. To activate the toner transfer device 40, the CPU loads the control program from the ROM and operates according to the control program. The RAM works as a work memory of the CPU, which can store various data including data computed by the CPU, data received by an operational panel (not shown) of the copier 100 or a sensor (not shown) of the copier 100, etc.

Referring back to FIG. 5, Step S1 detects toner shortage in the copier 100. In one example, as illustrated in FIG. 6, a toner density sensor 21 may be provided within or outside the developer 20 to continuously detect the toner density of the developer 20 and send the detection result to the controller 44. As shown in FIG. 3, in this exemplary embodiment, the toner density sensor 21 is provided with the developer 20. In another example, an image pixel counter, such as a photosensor or a charged coupled device (CCD) may be provided in the copier 100 to detect the number of pixels in a reference image formed on the photoconductor 12 and send the detection result to the controller 44.

When the controller 44 determines that the toner density, indicated by the detection result, is lower than a predetermined level ("YES" in Step S1), the operation proceeds to Step S2. When the controller 44 determines that the toner density is equal to or higher than the predetermined level ("NO" in Step S1), the operation returns to Step S1.

Step S2 supplies the toner from the toner bottle 31 to the developer 20. For example, the controller 44 generates a toner supply signal. According to the toner supply signal, the drive motor 45 drives the toner bottle 31 through the bottle gear. Referring to FIG. 7, as the toner bottle 31 rotates, a toner 39 in the bottle body 33 is transferred toward the cap 34 through the toner guide 38. Once it reaches the shutter 37, which is opened, the toner drops onto the inlet 43 of the toner transfer device 40 by its own weight.

As the first gear 46 is rotatably driven by the drive motor 45, the shaft 47 rotates and conveys the toner received by the inlet 43 downward through a transfer passage 64 as shown in FIG. 7. The toner is then accumulated in the toner holder 61. As the shaft 47 rotates, the rotating shaft 60*a* rotates and conveys the toner toward the transfer pipe 63 through the transfer passage 64 as shown in FIG. 7. The toner is further conveyed through the transfer pipe 63 to the developer container 17 of the developer 20.

Step S3 determines whether the toner density reaches the predetermined level in a substantially similar manner as described referring to Step S1. If the toner density reaches the predetermined level ("YES" in Step S3), the operation ends. If the toner density does not reach the predetermined level ("NO" in Step S3), the operation returns to Step S2 to supply the toner.

As described above referring to FIG. 1, a powder is placed in the transfer passage 64 before activation of the toner transfer device 40. Preferably, the powder includes any type of carrier, or any type of developing agent formed by a carrier and a toner. In this exemplary embodiment, a carrier 36, of ferrite type, is placed near the transfer coil 60*b* as shown in FIG. 7. However, a powder other than the carrier 36 may be placed in any portion of the toner transfer device 40. Further, in this exemplary embodiment, the carrier 36 has a particle size ranging from 22 μm to 88 μm with the average particle size of around 36 μm, however, the particle size of the carrier 36 is not limited to this example. Further, in this exemplary embodiment, the toner, of polyester resin, having a particle size of 6 μm to 12.5 μm is used. However, any type of toner may be applied depending on the structure of the copier 100.

When the toner transfer device 40 is activated for the first time after the copier 100 is shipped to a user, or when it is activated after replacement of the toner bottle 31, for example, the toner from the toner bottle 31 tends to fall into the developer 20 rather than staying in the toner transfer device 40 for various reasons. Examples of these reasons include increased fluidity of the toner as described in the '301 patent application. As a result, the toner is supplied to the developer 20 in an amount larger than expected, thus increasing the toner density in the developer 20. With the higher toner density, chargeability of the toner is reduced, thus causing scattering of the toner or background contamination.

In light-of the above-described and other problems, the carrier 36 is placed in the transfer passage 64 to suppress an amount of the toner falling into the developer 20 at the time before activation of the toner transfer device 40. Since the carrier 36 has the particle size larger than the particle size of the toner 39, the toner 39 is prevented from flowing into the developer 20. In addition to the particle size of the carrier 36, other characteristics of the carrier 36, such as irregularity in particle shapes or tendency to aggregate, may contribute to suppression of an amount of the toner falling into the developer 20.

In this exemplary embodiment, the amount of the carrier 36, i.e., the number of carrier particles, is previously set to be within the range between 2 g and 5 g. The amount of the carrier 36 may be determined depending on various characteristics including the type of the carrier 36, the type of the toner 39, or the structure of the copier 100 such as the type of the transfer coil 60*b*, for example.

Figure 8:
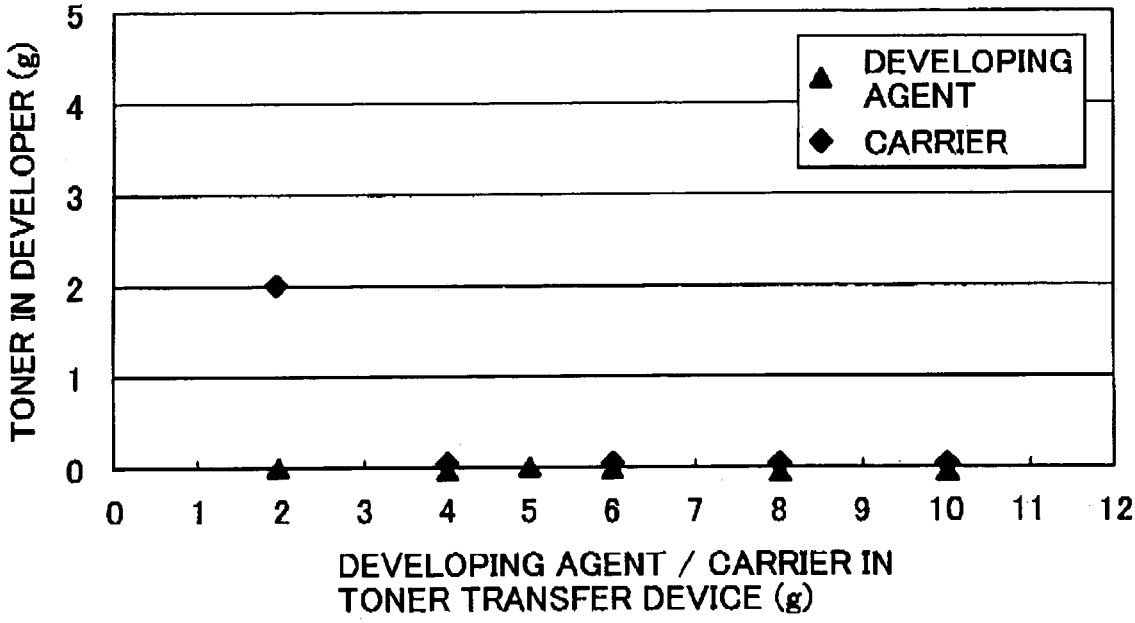
FIG. 8 is a graph showing the relationship between the amount of carrier or developing agent placed in the toner transfer device of FIG. 4 and the amount of toner which has flowed into a developer of FIG. 3.

To determine the amount of the carrier 36, the toner bottle 31, which is shaken a few times, is installed on the bottle holder 32. A predetermined amount of the carrier 36 is then placed near the transfer coil 60*b* of the toner transfer device 40. Without activating the toner transfer device 40, the amount of the toner which has flowed from the toner bottle 31 into the developer 20 through the toner transfer device 40 is observed. FIG. 8 illustrates an exemplary case of successively changing the predetermined amount of the carrier 36 from 2 g to 10 g. In this exemplary embodiment, the upper limit, i.e., 10 g, on the amount of the carrier 36 may be determined depending on various factors including the time it takes for the toner to be transferred from the toner transfer device 40 to the developer 20, or any influence on the image developing operation of the developer 20, for example. Referring to FIG. 8, the amount of the carrier 36 to be placed in the toner, transfer device 40 may be preferably set to be equal to or larger than 2 g.

Similarly, the amount of a developing agent may be determined, if the developing agent is to be placed on the transfer passage 64 of the toner transfer device 40 instead of the carrier. Referring to FIG. 8, the amount of the developing agent to be placed in the toner transfer device 40 may preferably be set to be equal to or larger than 4 g.

Figure 9:
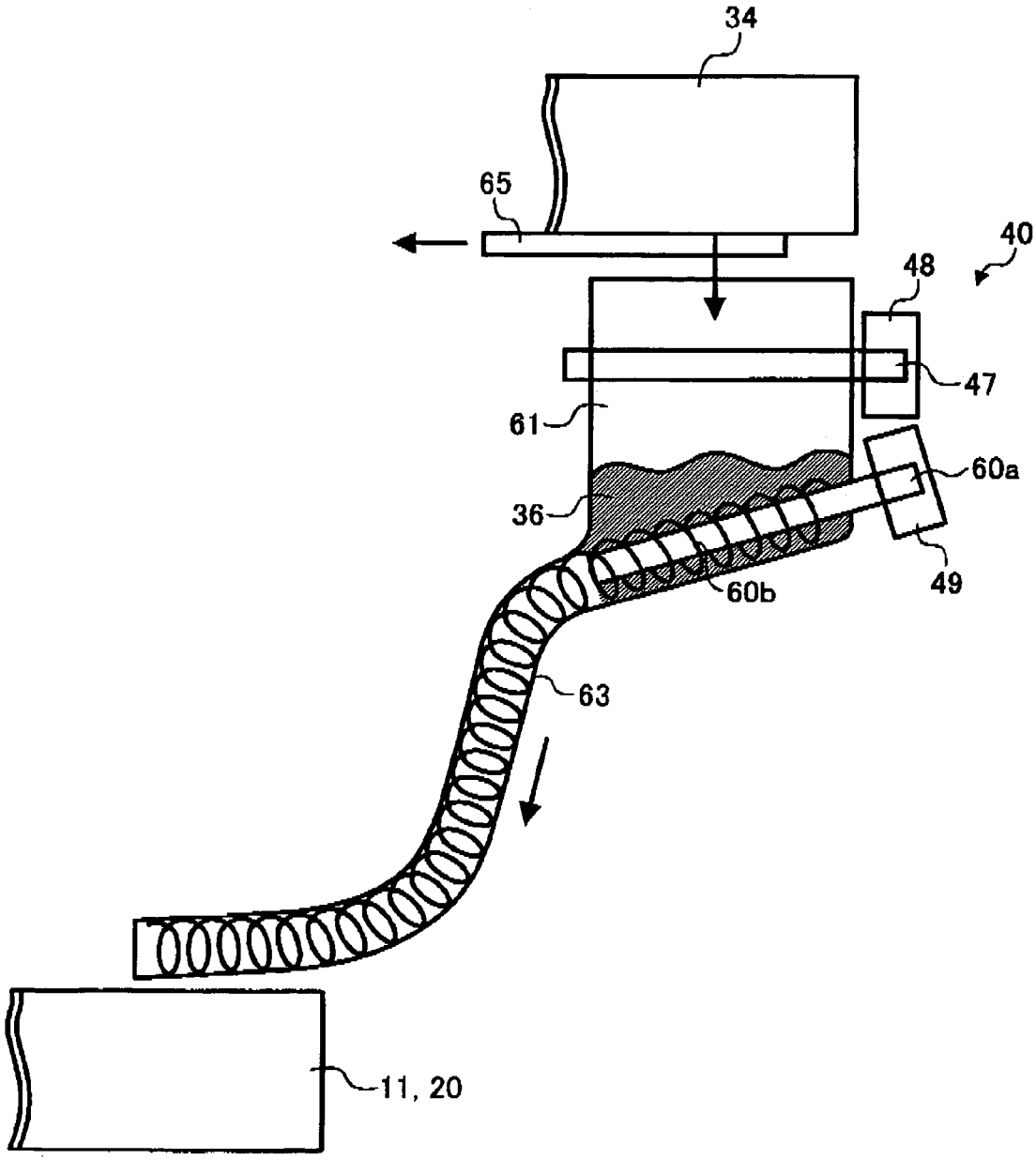
FIG. 9 is a schematic diagram for explaining an operation of placing a carrier in a toner transfer device, according to an exemplary embodiment of the present invention.

Referring now to FIG. 9, the operation of placing the carrier 36 in the transfer passage 64 of the toner transfer device 40 before activation of the toner transfer device 40 is explained according to an exemplary embodiment of the present invention.

As shown in FIG. 9, a seal 65 may be provided between the cap 34 and the toner transfer device 40 to seal the opening formed by the shutter-37. At this time, the cap 34 stores the carrier 36 having a desired amount determined by the above-described experiment. Before activation of the toner transfer device 40, such as when the copier 100 is used for the first time after shipment, the seal 65 is removed in the direction shown in FIG. 9.

This prevents the toner in the toner bottle 31 from falling into the toner transfer device 40 during shipment. In this manner, the desired amount of the carrier 36 is placed right before activation of the toner transfer device 40.

Alternatively, a case (not shown) for storing a desired amount of the carrier 36 may be provided between the cap 34 and the toner transfer device 40. The case has one opening facing the shutter 37, and the other opening, which is sealed by a seal, facing the inlet 43. During shipment, the carrier 36 stays within the case as the other opening is sealed. Before activation of the toner transfer device 40, such as when the copier 100 is used for the first time after shipment, the seal is removed to allow the carrier 36 to fall into the toner transfer device 40.

Figure 10:
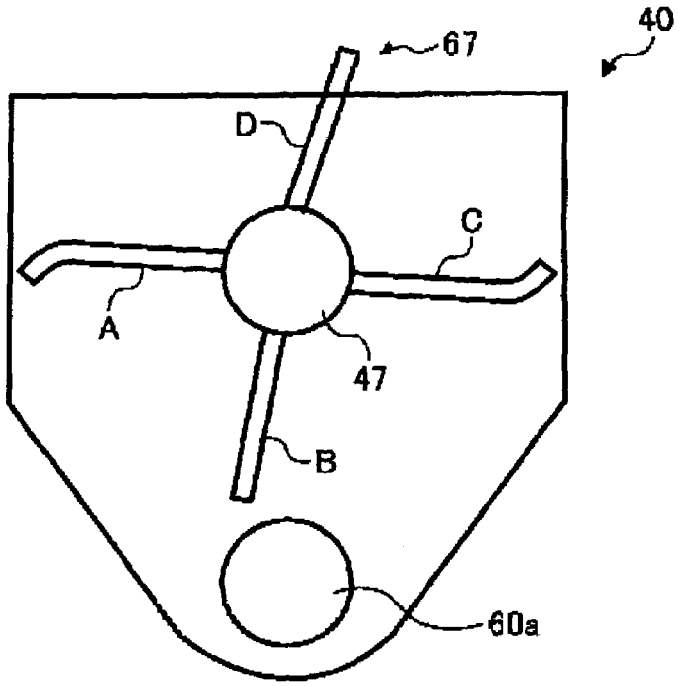
FIG. 10 is a schematic diagram illustrating a structure of an agitator of a toner transfer device, according to an exemplary embodiment of the present invention.
Figure 11:
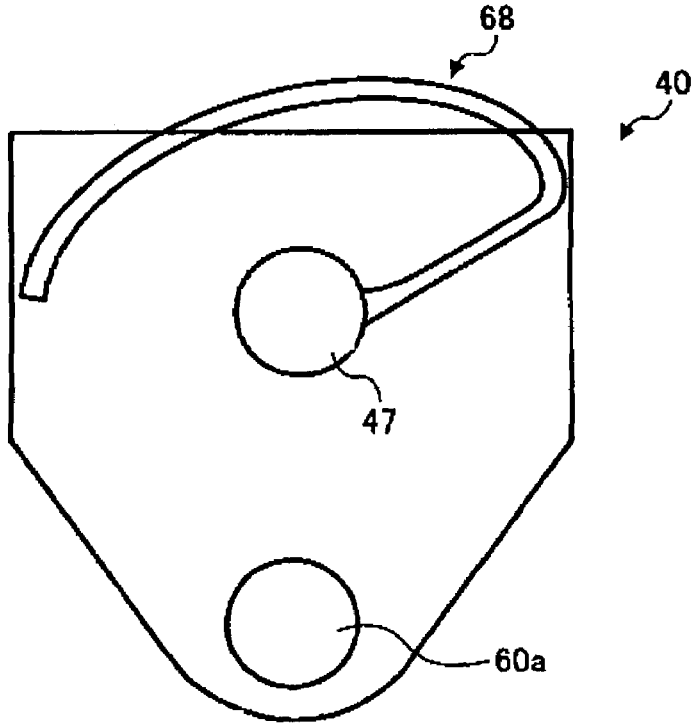
FIG. 11 is a schematic diagram illustrating a structure of an agitator of a toner transfer device, according to an exemplary embodiment of the present invention.

In another exemplary embodiment, in order to further suppress an amount of the toner falling into the developer 20 before activation of the toner transfer device 40, an agitator may be integrally formed on the shaft 47 as illustrated in FIG. 10 or 11, for example. Referring to FIG. 10, an agitator 67, which may be made of metal or resin, may be formed on the shaft 47. The agitator 67 includes four protruded sections A, B, C, and D, each section having a length sufficient for preventing the toner from falling into the developing device 20. Referring to FIG. 11, an agitator 68, which may be made of metal or resin, may be formed on the shaft 47. The agitator 68 includes one protruded section, which is spirally formed, for preventing the toner from falling into the developing device 20.

Figure 12A:
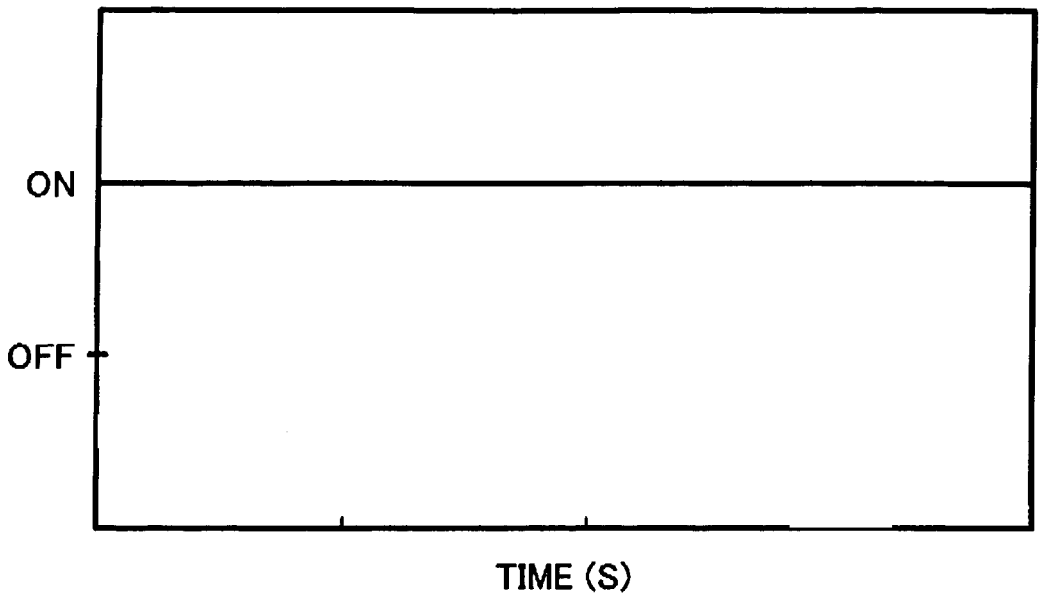
FIG. 12A is a graph showing an operation of continuously supplying a toner, performed by the toner transfer device of FIG. 4, according to an exemplary embodiment of the present invention.
Figure 12B:
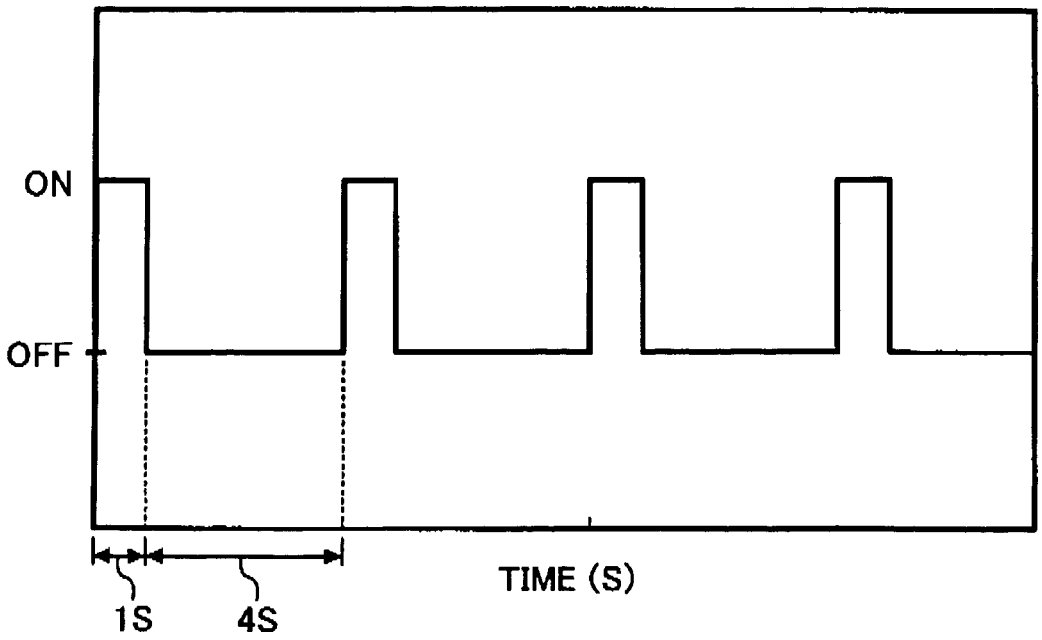
FIG. 12B is a graph showing an operation of intermittently supplying a toner, performed by the toner transfer device of FIG. 4, according to an exemplary embodiment of the present invention.
Figure 13:
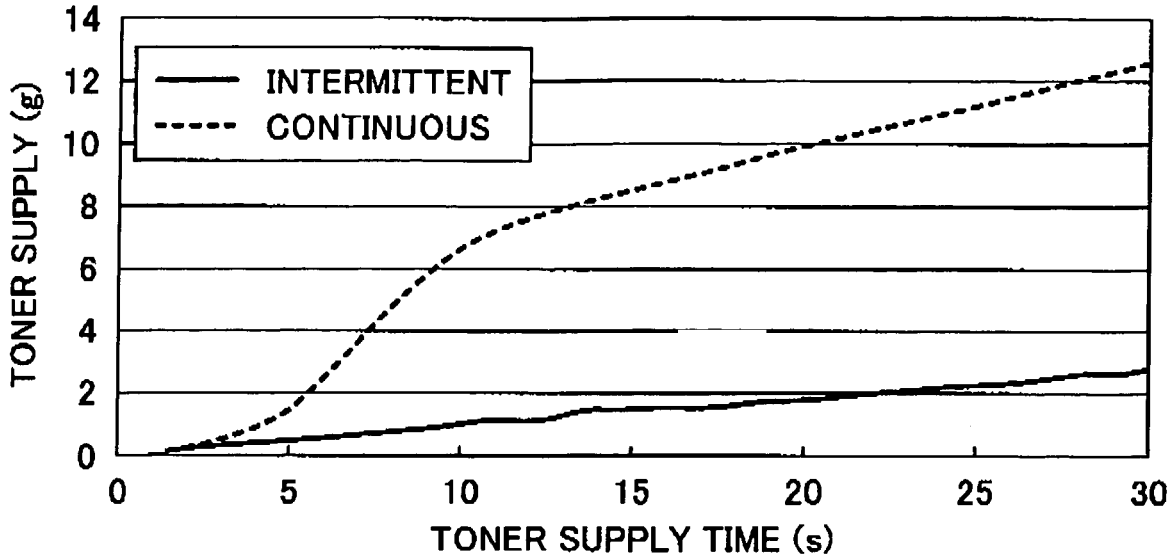
FIG. 13 is a graph showing the relationship between a toner supply time period and the amount of toner continuously or intermittently supplied to the developer of FIG. 3 by the toner transfer device of FIG. 4, according to an exemplary embodiment of the present invention.

Further, the toner transfer device 40 may supply the toner continuously as illustrated in FIG. 12A, or it may supply the toner intermittently as illustrated in FIG. 12B. Referring to FIG. 12A, the controller 44 continuously drives the toner transfer device 40 until the toner density in the developer 20 reaches a predetermined level. Referring to FIG. 12B, the controller 44 repeats an intermittent toner supply operation of driving the drive motor 45 for one second and stopping the drive motor 45 for four seconds. By stopping the drive motor 45 for a specific time period rather than continuously driving it, the fluidity of the toner in the toner transfer device 40 is lowered. As a result, the amount of the toner falling into the developer 20 may be suppressed as illustrated in FIG. 13, as compared to the case of continuously providing the toner. In this exemplary embodiment, the drive motor 45 is stopped for four seconds, however, the time period for stopping the drive motor 45 is not limited to this example. For example, the time period for stopping the drive motor 45, or the ON/OFF ratio of the intermittent operation, may be determined according to the amount of toner initially packed in the toner bottle 31. As described referring to FIG. 17 of the '301 patent application, an identification (ID) chip may be provided in the cap 34 of the toner bottle 31 to detect the amount of toner contained in the toner bottle 31. Similarly, the time period for driving the drive motor 45 is not limited to one second.

Figure 14:
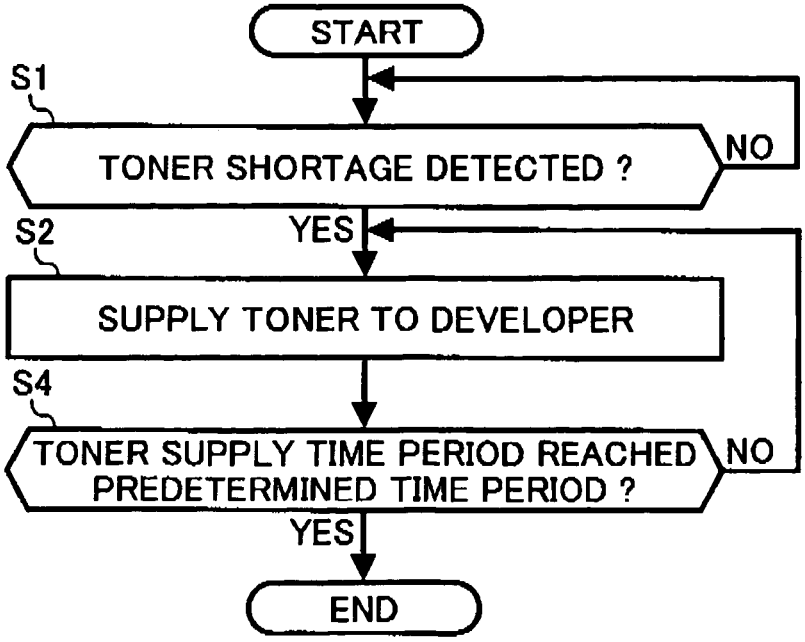
FIG. 14 is a flowchart illustrating an operation of supplying a toner, performed by the toner transfer device of FIG. 4, according to an exemplary embodiment of the present invention.

Referring now to FIG. 14, the operation of supplying a toner, performed by the toner transfer device 40, is explained, according to an exemplary embodiment of the present invention. The operation illustrated in FIG. 14 is substantially similar to the operation illustrated in FIG. 5. The differences include the replacement of Step S3 with Step S4. Further, in this exemplary embodiment, the controller 44 additionally includes a timer capable of counting a time period of a toner supply operation ("toner supply time period"). The toner supply time period is counted when Step S2 is started by the controller 44 after Step S1.

Step S4 determines whether the toner supply time period reaches a predetermined time period. If the toner supply time period reaches the predetermined time period ("YES" in Step S4), the operation ends. If the toner supply time period does not reach the predetermined time period ("NO" in Step S4), the operation returns to Step S2 to continue the toner supply operation.

In this exemplary embodiment, the predetermined time period may be determined by observing the amount of toner supplied to the developer 20 over a specific time period.

Figure 15:
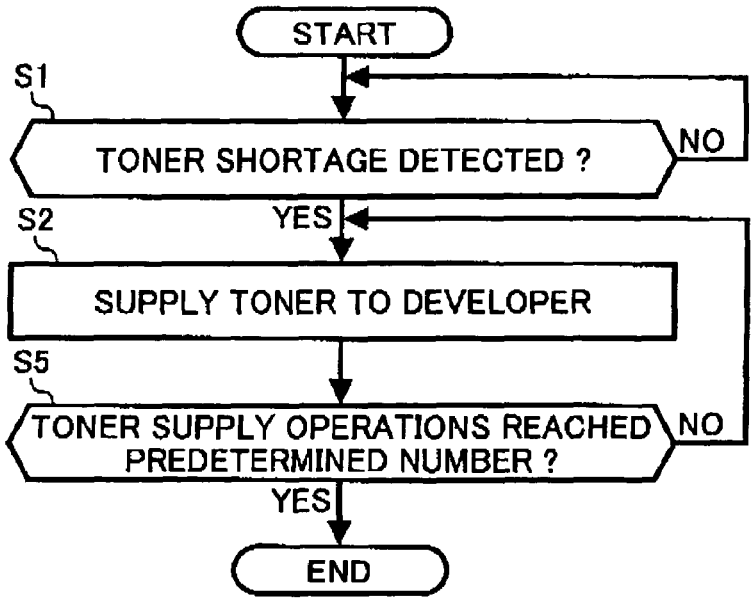
FIG. 15 is a flowchart illustrating an operation of supplying a toner, performed by the toner transfer device of FIG. 4, according to an exemplary embodiment of the present invention.
Figure 16:
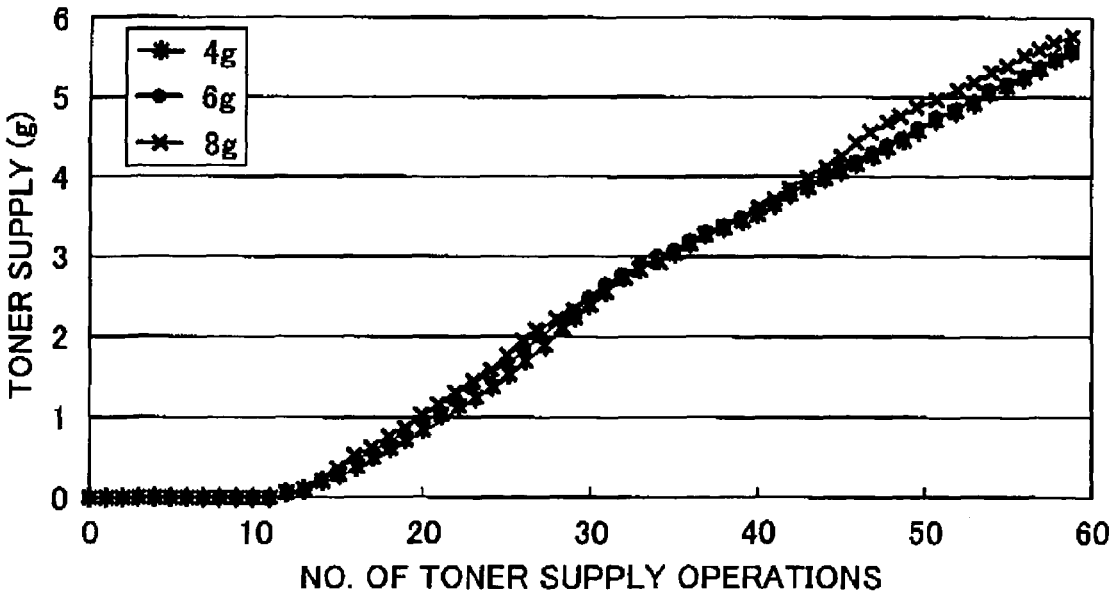
FIG. 16 is a graph showing the relationship between a number of intermittent toner supply operations performed by the toner transfer device of FIG. 4 and an amount of toner supplied to the developer of FIG. 3, according to an exemplary embodiment of the present invention.

Referring now to FIGS. 15 and 16, the operation of supplying a toner, performed by the toner transfer device 40, is explained according to an exemplary embodiment of the present invention. The operation illustrated in FIG. 15 is substantially similar to the operation illustrated in FIG. 5. The differences include the replacement of Step S3 with Step S5. Further, an intermittent toner supply operation is preferably performed in Step S2, such as the operation of FIG. 12B for driving the drive motor 45 for one second and stopping the drive motor 45 for four seconds. Furthermore, the controller 44 additionally includes a counter capable of counting a number of intermittent toner supply operations.

Step S5 determines whether the number of intermittent toner supply operations reaches a predetermined number. If the number of intermittent toner supply operations reaches the predetermined number ("YES" in Step S5), the operation ends. If the number of intermittent toner supply operations does not reach the predetermined number ("NO" in Step S5), the operation returns to Step S2 to perform another intermittent toner supply operation.

In this exemplary embodiment, the predetermined number of intermittent toner supply operations may be determined by observing the amount of toner supplied to the developer 20 over a specific timer period, as illustrated in FIG. 16. Referring to FIG. 16, after repeating the intermittent toner supply operations for about 10 times, the toner is supplied to the developer 20. Thus, the predetermined number may be set to be 10 or any number larger than 10.

Numerous additional modifications and variations are possible in light of, the above teachings. It is therefore to be understood that within the scope of the appended claims, the disclosure of this patent specification may be practiced otherwise than as specifically described herein. Fox example, elements and/or features of different illustrative embodiments may be combined with each other and/or substituted for each other within the scope of this disclosure and appended claims.

Further, the structure of the process cartridge 11 is not limited to the structure shown in FIG. 3. For example, the structure of the developer 20 may differ depending on the developing method to be applied by the developer 20. Furthermore, a part or the entire operation illustrated in any one of FIGS. 5, 14, and 15 may be performed by a processor other than the controller 44. For example; an external processor, such as a personal computer, may be connected to the image forming apparatus 1 shown in FIG. 1 to control the operation of the image forming apparatus 1 according to the control program. The control program may be stored in any kind of storage medium.

Alternatively, a part or the entire operation illustrated in any one of FIGS. 5, 14, and 15 may be implemented by ASIC, prepared by interconnecting an appropriate network of conventional component circuits or by a combination thereof with one or more conventional general purpose microprocessors and/or signal processors programmed accordingly.

This patent specification is based on and claims priority to Japanese patent application Nos. 2004-260671 filed on Sep. 8, 2004, and 2004-336337 filed on Nov. 19, 2004, in the Japanese Patent office, the entire contents of each of which are hereby incorporated by reference.

The invention claimed is:

1. An image forming apparatus, comprising:

a toner storage device removably installed on the image forming apparatus and configured to store a toner;

an image forming device removably installed on the image forming apparatus independently from the toner storage device and provided with a developer; and a toner transfer device, comprising a single transfer passage therein, provided between the toner storage device and the image forming device and configured to supply the toner from the toner storage device to the developer through the single transfer passage, wherein a powder is placed in the single transfer passage at a first time point before activation of the toner transfer device.

2. The apparatus of claim 1, wherein the powder includes a carrier.

3. The apparatus of claim 2, wherein the powder further includes a toner to be mixed with the carrier to form a developing agent.

4. The apparatus of claim 1, wherein the powder is larger in particle size than the toner.

5. The apparatus of claim 1, wherein the powder includes a predetermined amount of particles.

6. The apparatus of claim 1, wherein the first time point is after shipment of the image forming apparatus.

7. The apparatus of claim 1, wherein the image forming device is arranged at a downside position with respect to the toner storage device.

8. The apparatus of claim 1, wherein the toner transfer device supplies the powder from the transfer passage to the developer at a second time point after activation of the single toner transfer device.

9. The apparatus of claim 8, wherein the powder is supplied for a predetermined time period.

10. The apparatus of claim 8, wherein the powder is supplied by repeating an intermittent toner supply operation.

11. The apparatus of claim 10, wherein the intermittent toner supply operation is repeated a predetermined number of times.

12. A toner transfer device for use in an image forming apparatus, comprising:

means for inputting a toner;

means for outputting the toner;

means for transferring the toner from the inputting means to the outputting means which comprises a single passage means; and means for driving the transferring means according to a signal generated by the image forming apparatus, wherein a powder is placed in the single passage means near the transferring means at a first time point before the driving means drives the transferring means.

13. The device of claim 12, further comprising:

means for agitating the toner, provided between the inputting means and the transferring means.

14. The device of claim 13, wherein the agitating means comprises means for preventing the toner from moving toward the transferring means.

15. The device of claim 12, further comprising:

means for preventing the toner from being input to the inputting means before the first time point.

16. The device of claim 15, wherein the preventing means stores the powder before the first time point.

17. A method for transferring a toner from a toner storage device to an image forming device through a single transfer passage in an image forming apparatus, comprising the steps of:

placing a powder in the single transfer passage before activation of the toner storage device;

transferring the powder together with the toner to the image forming apparatus after activation of the toner storage device.

18. The method of claim 17, wherein the placing step comprises the steps of:

storing the powder outside the single transfer passage before shipment of the image foaming apparatus; and transferring the powder to the transfer passage after shipment of the image forming apparatus.

19. The method of claim 17, wherein the transferring step is performed intermittently.

20. The method of claim 17, wherein the transferring step is performed for a predetermined time period.

21. The method of claim 17, wherein the toner storage device and the image forming device are removably installed on the image forming apparatus independently from each other.

22. The apparatus of claim 1, further comprising:

a processor;

a storage device configured to, when activated by the processor, cause the processor to perform a toner supply operation including the steps of:

detecting toner shortage in the image forming apparatus to generate a detection result; and driving the toner transfer device to cause the toner transfer device to supply the toner from the toner storage device through a single transfer passage to the developer according to the detection result.

23. A method for forming a toner image, comprising the steps of:

providing a toner storage device storing a toner and an image forming device, which are communicated through a single transfer passage;

placing a powder in the single transfer passage before activation of the toner storage device;

transferring the powder together with the toner to the image forming device after activation of the toner storage device.

* * * * *